US005584136A

United States Patent [19]

Boland et al.

[11] Patent Number: 5,584,136

[45] Date of Patent: Dec. 17, 1996

[54] MAGAZINE ADAPTER

[75] Inventors: James W. Boland, Vista; Michael L. McCarthy, Oceanside, both of Calif.

[73] Assignee: Greene International West Inc., Oceanside, Calif.

[21] Appl. No.: 373,973

[22] Filed: Jan. 18, 1995

Related U.S. Application Data

[63] Continuation-in-part of Ser. No. 370,199, Jan. 8, 1995.

[51] Int. Cl.[6] ..... F41A 9/24

[52] U.S. Cl. ..... 42/7; 42/50

[58] Field of Search ..... 42/7, 18, 22, 50, 42/49.02

[56] References Cited

U.S. PATENT DOCUMENTS

| | | | |
|---|---|---|---|
| 1,015,490 | 1/1912 | Harrington | 42/7 |
| 4,586,281 | 5/1986 | Chestnut | 42/50 |
| 4,586,282 | 5/1986 | Sniezak | 42/71.02 |
| 5,293,708 | 3/1994 | Strayer et al. | 42/7 |
| 5,438,783 | 8/1995 | Sniezak et al. | 42/50 |

*Primary Examiner*—Michael J. Carone
*Attorney, Agent, or Firm*—James Creighton Wray

[57] ABSTRACT

A firearm skirt/magazine assembly used for safe insertion within a stock of a firearm when the stock is shorter in length than the magazine incorporates a skirt having an open end and a curved end wherein the curved end defines a generally curved upraised portion and the open end is shaped to correspond to the exterior cross-section of the magazine, so that the skirt may fit/snugly around the magazine. In use, when the skirt/magazine assembly is inserted into the stock of the handgun, the upraised portion abuts against a bottom end of the stock thereby preventing the firearm's interworking parts from being damaged by over-insertion of the magazine. Additionally, the magazine defines a magazine chamber for housing cartridges having a follower mounted for sliding movement and adapted to contact one of the cartridges and spring means for urging the follower in a direction towards a discharging end of the magazine, wherein the magazine defines a slot located having a shape and position such that when a user attempts to insert one more cartridge than intended to be housed within the magazine chamber, the follower is forced through the slot thereby disabling the spring means for urging the follower in a direction towards the discharging end of the magazine.

18 Claims, 2 Drawing Sheets

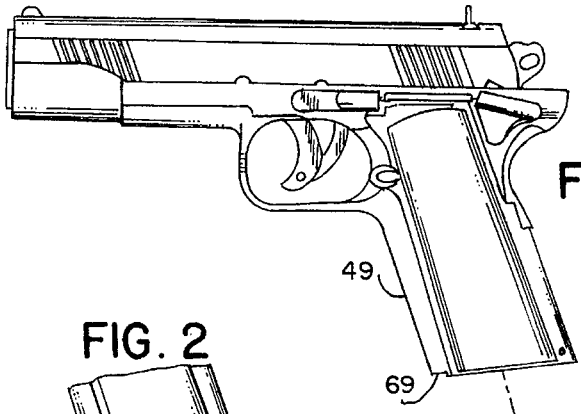
FIG. 1
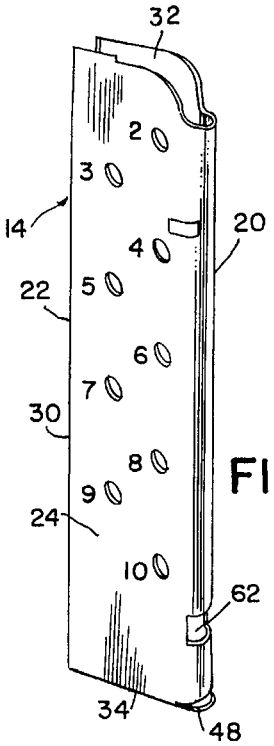
FIG. 4
FIG. 2
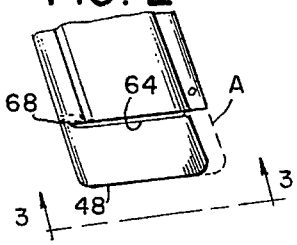
FIG. 3
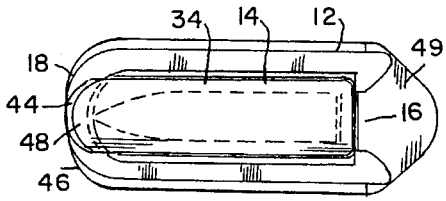
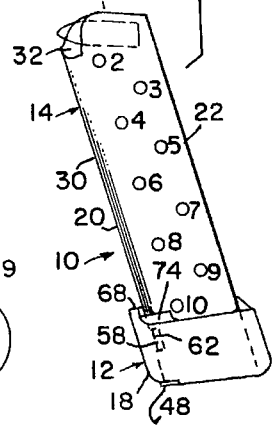
FIG. 8
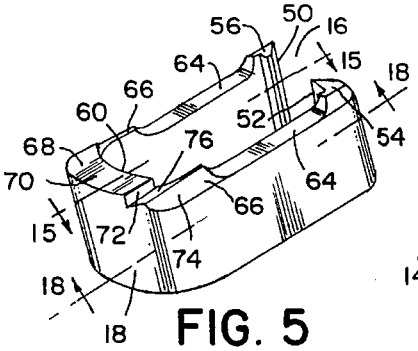
FIG. 5
FIG. 7
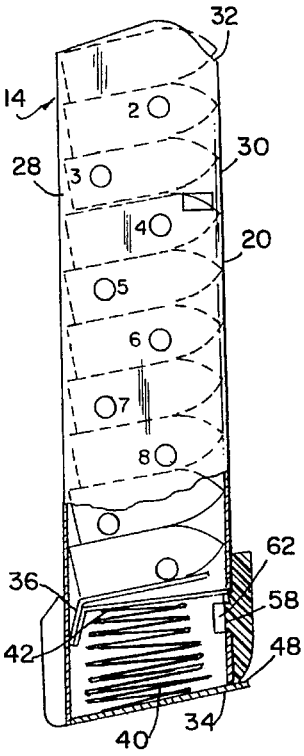
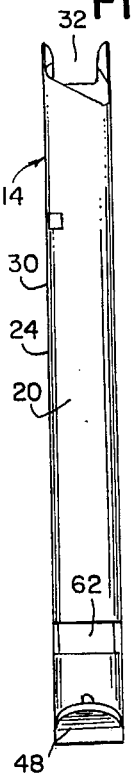
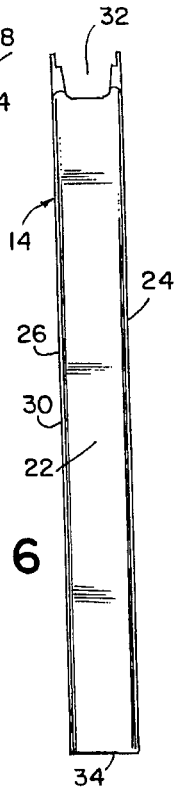
FIG. 6

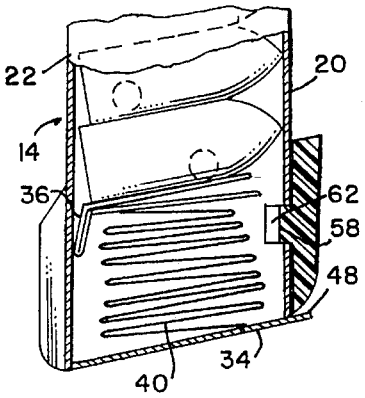
FIG. 9
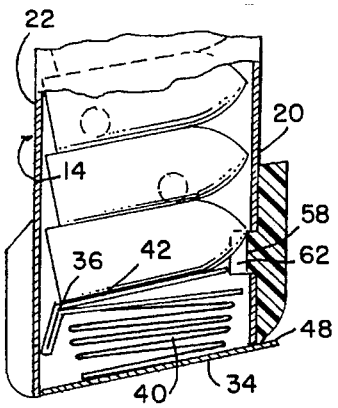
FIG. 10
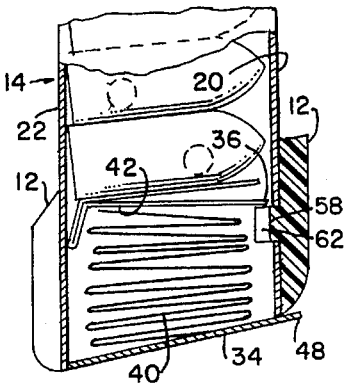
FIG. 11
FIG. 12
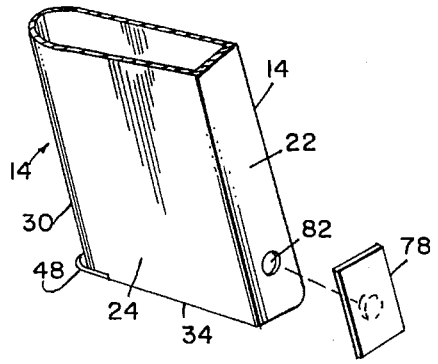
FIG. 13
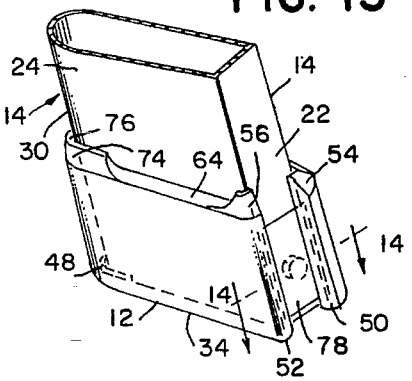
FIG. 15
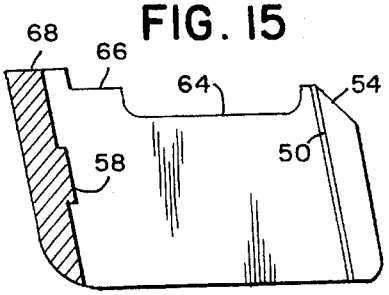
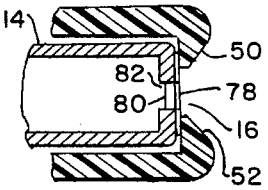
FIG. 14
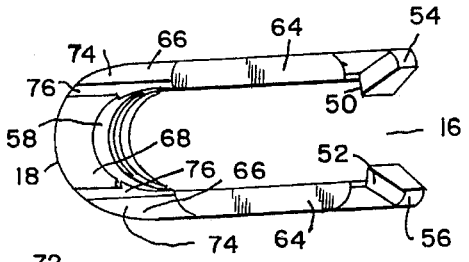
FIG. 16
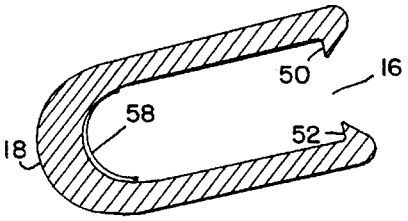
FIG. 18
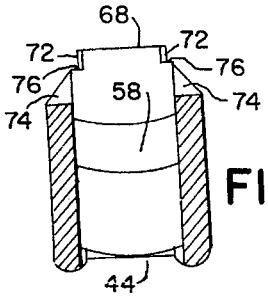
FIG. 17

MAGAZINE ADAPTER

CROSS-REFERENCE

This application is a continuation-in-part of application Ser. No. 08/370,199 filed Jan. 8, 1995, entitled "Firearm Capable of Operation With Different Capacity Magazines" by James W. Boland.

BACKGROUND

The present invention relates to an adapter for attachment to a lower portion of a magazine for a firearm. In particular, the present invention relates to a magazine base skirt for attachment to a magazine wherein the magazine is longer than the magazine well in the firearm stock or grip into which the magazine is inserted.

With the popularity of competitive target shooting with firearms, rapid-fire firearm target shooting activities have become a significantly important aspect of these type of shooting events. More particularly, considerable interest has developed toward the provision of having firearms with increased round capacity, as compared to the standard 1911 A1 firearm which, in 0.45 caliber ACP, typically has a magazine capacity of only seven rounds or eight.

In response to the problem of increased round capacity, there are a number of autoloading firearm designs being presently marketed which employ staggered-row cartridge enhanced capacity magazines wherein the frame of the firearm construction has a handgrip and magazine receptacle of sufficiently large internal dimension that larger, staggered row magazines can be received for enhanced round capacity. However, recently passed Federal regulations limit the amount of rounds that may be loaded into these type of firearms.

Therefore, there is a need for an extended magazine having increased round capacity that may be safely inserted into a standard autoloading firearm such as a government model or the Colt Model 1911 A1 firearm without damaging the firearm's interworking parts and without having to redesign the firearm, yet conforms to Federal regulations by disabling the magazine when a user attempts to insert more cartridges than allowed by law.

The subject invention herein solves all of these problems in a new and unique manner which has not been part of the art previously. Some related patents are described below:

U.S. Pat. No. 5,293,708 discusses a frame/handgrip assembly for autoloading handguns comprising a metal frame structure having guide rails for receiving a conventional slide and for receiving other standard 1911 A1 components. The frame structure defines an internal handgrip having one or more internal keys for establishing mating, interlocked structural relationships with opposed handgrip seats. The frame and handgrip structure may cooperatively define a wide internal magazine receptacle for receiving a wide staggered row, enhanced volume cartridge magazine.

U.S. Pat. No. 4,586,282 discusses a grip assembly having a pair of side grips and a heel grip. Each side grip has a plurality of inwardly directed projections arranged to conform to the outline of a frame. The heel grip includes a leaf spring and opposite lateral edges which engage the side grips in final assembly to lock the rear edges of the side grips against movement laterally outwardly from the frame.

U.S. Pat. No. 4,586,281 discusses a cartridge magazine for storing cartridges that may be used with a plurality of firearms. More particularly for use with the Colt M16/AR-15 and the Ruger Mini-14/AC 556 styles of firearms. The cartridge magazine includes a number of different latch-related elements for use in engaging different cartridge magazine latching mechanisms found on each style of firearm. A positioning member located on the magazine assists alignment of the cartridges during loading into the firearm so that jamming of the cartridges is eliminated.

While the basic concepts presented in the aforementioned patents are desirable, none of the apparatus employed by each produce a skirt/magazine assembly for a firearm capable safe insertion into the stock of the firearm and for disabling the magazine when a user attempts to exceed the cartridge capacity.

SUMMARY

A firearm skirt/magazine assembly used for safe insertion within a stock of a firearm when the stock is shorter in length than the magazine incorporates a magazine base skirt having an open end and a curved end wherein the curved end defines a generally curved upraised portion and the open end is shaped to correspond to the exterior cross-section of the magazine, so that the skirt may fit snugly around the magazine. Also, means are provided on the skirt to enable it to be secured firmly to the lower end of the magazine. In use, when the skirt/magazine assembly is inserted into the stock of the handgun, the upraised portion abuts against a bottom end of the stock thereby preventing the firearm's interworking parts from being damaged by over-insertion of the magazine.

Additionally, the magazine defines a chamber for housing cartridges having a follower mounted for sliding movement and adapted to contact one of the cartridges and spring means for urging the follower in a direction towards a discharging end of the magazine, wherein the magazine defines a slot having a shape and position such that when a user attempts to insert one more cartridge than intended to be housed within the magazine chamber, the follower is forced through the slot thereby disabling the spring means for urging the follower in a direction towards the discharging end of the magazine.

An object of the present invention is to provide a firearm skirt/magazine assembly for autoloading firearms which prevents a user from inserting more cartridges in the magazine chamber than the magazine chamber is designed to house.

Another object of the present invention is to have a firearm skirt/magazine assembly for autoloading firearms which is not only functional but also affords a smooth, continuous and uninterrupted lower extension for the entire stock profile of the firearm.

A further object of the present invention is to provide a skirt for the magazine of an autoloading firearm which is readily removable and replaceable with others of different appearance or design.

Still, yet another object of the present invention is to provide an uncomplicated firearm safety device that protects the firearms interworking parts when an extended magazine is fully inserted into the firearm magazine chamber.

Yet another object of the present invention is to have a firearm skirt/magazine assembly for autoloading firearms that accepts 10 cartridges and may be inserted into any Colt 0.45 Standard Model, also known as the 1911 Government Model 0.45 caliber type firearm without damaging the firearm.

Accordingly, it is an object of the present invention to provide a firearm skirt/magazine assembly which prevents the magazine from damaging the interworking parts of the firearm as well as limiting the number of cartridges which may be inserted into the magazine.

DRAWINGS

The above, as well as other, advantages of the present invention will become clear from the following description and drawings where:

FIG. 1 is an exploded left side view of a firearm, specifically a government model 0.45 ACP semiautomatic pistol, showing a single-cartridge row, extended-round magazine (in the illustration it is a ten round magazine) with a magazine adapter or base skirt constructed according to the present invention attached to a lower portion of the magazine. Proceeding from the top to the bottom of the extended round magazine in FIG. 1, there is shown in phantom a cartridge loaded into the top of the magazine, a magazine catch receptacle (on the left side of the magazine) and the lower porion of the extended round magazine which is covered by the base skirt;

FIG. 2 is a partial left side view of the lower portion of the grip of the pistol shown in FIG. 1 illustrating a magazine with attached base skirt fully inserted into the magazine well of the grip. Shown in phantom is the upper right side of the base skirt;

FIG. 3 is a bottom plan view taken along the line 3—3 in FIG. 2, showing in phantom a cartridge in the bottom of the single cartridge row, extended round magazine of FIG. 1;

FIG. 4 is a perspective view of a single cartridge row, extended round magazine (specifically a 0.45 ACP ten round magazine) constructed according to the present invention;

FIG. 5 is a perspective view of a base skirt constructed according to the present invention;

FIG. 6 is a rear elevational view of the magazine shown in FIG. 4;

FIG. 7 is a cutaway side view of the magazine shown in FIG. 4 with the base skirt shown in FIG. 5 attached to the magazine. The magazine is shown fully loaded with ten cartridges, and the first eight cartridges are shown in phantom;

FIG. 8 is a front elevational view of the magazine shown in FIG. 4;

FIG. 9 is an enlarged view of the cross sectional area bound by line 9—9 of FIG. 7

FIG. 10 is the FIG. 9 view showing a modified magazine spring and eleven rounds inserted into the magazine;

FIG. 11 is the FIG. 10 view showing an inoperative or jammed magazine follower after removal (as by firing the FIG. 1 pistol loaded with the FIG. 10 magazine) of a cartridge from the top of the magazine;

FIG. 12 is an exploded rear perspective view showing an extended round magazine and a shim for attachment to the magazine. A button on the shim is shown in phantom;

FIG. 13 is another embodiment of the present invention showing the shim and the base skirt assembled over an extended round magazine;

FIG. 14 is a sectional view taken along line 14—14 in FIG. 13.

FIG. 15 is a side cross sectional view of the base skirt taken along the line 15—15 in FIG. 5 (showing in effect one of the two side prongs of the u of the u-shaped base skirt removed);

FIG. 16 is a top perspective view of the base skirt;

FIG. 17 is a front elevational view of the base; and

FIG. 18 is a top plan view of the cross sectional view taken along line 18—18 in FIG. 5.

DESCRIPTION

The present invention is based upon the discovery that an extended round magazine can be fully inserted into the magazine well in the grip of an automatic or semiautomatic pistol with a substantially reduced risk of damage to pistol components by attaching a base skirt to a lower portion of the magazine. The present invention is also based upon the discovery that an extended round magazine can be rendered inoperative should a user insert into the magazine more cartridges than for which the magazine was constructed by making a cutout modification of the magazine. Additionally, the present invention is based upon the discovery that a magazine base skirt assembly can provide both the advantages set forth above.

An embodiment of the present invention can comprise a firearm magazine base skirt. The base skirt is a generally horseshoe or u-shaped item adapted to fit over a lower portion of a firearm magazine. The lower portion of the firearm magazine is that portion of the magazine which extends outside the grip well of a pistol after the magazine has been fully inserted into the grip well. Preferably the base skirt is constructed of a suitable material such as metal (i.e. stainless steel) or plastic. Plastic is preferred because of its wear resiliency and ease of molding into the disclosed base skirts.

The magazine used in conjunction with the base skirt is preferably a single-cartridge column, extended length magazine which is adapted to fit into the magazine or grip well of an automatic or semiautomatic pistol. More preferably, the magazine is adapted for insertion into the magazine or grip well of a 0.45 ACP government model pistol. Most preferably, the magazine is a single-column, extended length magazine adapted to hold ten 0.45 AC cartridges. By "extended length" it is meant that when fully inserted into the grip well of a pistol, a lower portion of the magazine extends outside the grip well. In other words, an extended length magazine does not fit flush with the bottom of the grip of the pistol. The base skirt is designed to fit over that portion of an extended length magazine which extends outside the grip well. Thus, upon attachment of the base skirt, the width of the extended portion of the magazine has an apparent width (i.e. magazine width plus base skirt width) which is the same or substantially the same as the width of the pistol grip. Thus, insertion of an extended length magazine bearing the base skirt, provides in effect an "extended grip" pistol, due to the smooth feel and appearance, whereby there is no longer any abrupt discontinuity between the end of the grip and the portion of the extended round magazine which extends outside of the grip well.

The disclosed base skirt can also be used in conjunction with an extended-length, wide body (or two staggered cartridge row) magazine. Thus, in another embodiment, the base skirt is adapted for attachment to that portion of a wide body magazine which extends outside and beyond the lower end of the grip well of a wide body pistol.

Referring now to the drawings wherein like reference numerals refer to like and corresponding parts throughout, a firearm skirt/magazine assembly 10 of the present invention comprises a generally u-shaped member or magazine base skirt 12 which can be used in association with a firearm magazine 14. The magazine 14 is preferably a single-cartridge column, extended length magazine used in conjunction with an automatic or semiautomatic pistol. More preferably, the magazine 14 is adapted for insertion into the magazine or grip well of a 0.45 ACP government model pistol. Most preferably, the magazine 14 is a ten round, single column magazine.

As shown in FIG. 5, the u-shaped member 12 defines a curved end 18 and an open end 16 shaped to correspond to the cross-sectional shape of the magazine 14, such that the u-shaped member 12 can fit snugly and securely around the magazine 14, as shown in FIG. 1.

Referring now to FIGS. 1 and 4, the extended round magazine 14 comprises a generally rectangular shaped case 30 for storing cartridges, having an open cartridge discharge or egress end 32. The open end 32 is at the top of the magazine 14. The magazine 14 also has a closed bottom end 34. The case 30 comprises a front wall 20, a rear wall 22, a first side wall 24, and a second side wall 26. The interior surfaces of the four walls 20, 22, 24, 26 respectively, define a chamber 28 within the magazine 14 for housing cartridges shown in phantom. In a preferred embodiment, the chamber 28 within the case 30 has a length adapted to hold a maximum of ten 0.45 caliber cartridges.

As shown in FIG. 7, a follower 36 is mounted for sliding movement within the chamber 28 of the magazine 14 and is adapted to contact one of the cartridges and includes a means for urging the follower 36 in a direction towards the discharging end 32 of the case 30. The means for urging the follower 36 can comprise a spring 40 affixed to an underside 42 of the follower 36 at one end and is affixed to the closed end 34 of the case 30 at the other end of the spring 40.

The u-shaped member 12 defines a groove 44 located along a convex bottom edge 46 of the closed end 18 of the u-shaped member 12 having a shape and position so as to be capable of receiving an extended tab portion or flange 48 located at the closed end 34 of the magazine 14. The groove 44 and the extended tab portion 48 align the skirt 12 with the magazine 14 in a forwardly supported interfitting relation for insertion into a stock or grip 49 of a firearm. The extended tab portion 48 when in engagement with the groove 44 provides an additional degree of alignment and further maintains the skirt 12 and magazine 14 in an assembled relationship. The interaction of the extended tab portion 48 of the magazine 14 and the groove 44 on the bottom of the skirt 12 provides a means by which the magazine 14 firmly abuts against the skirt 12. Combined with the interaction of the slot 62 and the lip 58, the skirt 12 is thereby firmly positioned on the magazine 14 so as to substantially reduce the possibility of overinsertion of the magazine 12 into the grip well of a pistol.

Referring now to FIG. 5, the u-shaped member 12 defines a plurality of inwardly orientated and vertically disposed, wedge-shaped hooks 50 and 52 located along the open end 16 of the skirt 12. The hooks 50 and 52 of the open end 16 of the u-shaped member 12 can register with the exterior rear wall 22 of the magazine. The inwardly bevelled surfaces 54 and 56 are located at the position where a palm of a hand of a user tends to press against the lower portion of the magazine 14 while loading the skirted magazine into a pistol, while using (i.e. firing), or removing the skirted magazine from the grip well. A function of the bevelled surfaces 54 and 56 is to reduce or prevent scraping or cutting of the user's hand as it is compressed to or rubbed against the skirted magazine.

The u-shaped member 12 is preferably made from a resilient material, such as plastic or hard rubber, thereby allowing the hooks 50, 52 respectively, to engage the exterior rear wall 22 of the magazine 14 in releasable interlocking assembly, as shown in FIG. 1. The base skirt or u-shaped member is preferably a single piece of injection molded plastic. The particular configuration of the final base skirt can be accomplished by a variety of machining methods for cutting and accurately shaping small plastic work piece.

The u-shaped member 12 can define an upraised curved portion or lip 58 located along a concave (internal side) surface 60 of the closed end 18 of u-shaped member 12 for registry with the front wall 20 of the magazine 14. The front wall 20 of the magazine 14 defines a slot 62 which is shaped and positioned to receive the upraised curved portion 58 of the base skirt 12 thereby further maintaining the skirt 12 and the magazine 14 in an assembled relationship. The position of lip 58 is important for several reasons. First, and as indicated above, lip 58 helps to lock the skirt 12 onto the magazine 14 due to interaction of the lip 58 with the mating slot 62.

The curved end 18 of u-shaped member or base skirt 12 has a top surface 64 with a first shoulder 66, and a second shoulder 68. The first shoulder 66 has a flat top 70 and side walls 72 arranged at right angles to the top 70. The second shoulder 68 has two inclined walls 74 on opposite sides of the first shoulder 66. The inclined walls 74 are symmetrical. Between the vertical side walls 72 and the inclined walls 74 there can be a horizontal abutment space 76.

The first shoulder 66 is adapted and so disposed to fit wholly into the magazine 14 upon attachment of the skirt 12 to the magazine 14, as shown best by FIG. 2. In a preferred embodiment of the present invention, the first shoulder 68 mates with a groove 69 in the bottom of the grip 49. Groove 69 can also serve to mate with a flange on the bottom of the magazine of a standard length (i.e. an eight round 0.45 ACP single column, narrow body) magazine, which flange corresponds in position to the flange 48 of the extended length magazine disclosed herein. The horizontal abutment space 76 forms a position upon which the lower grip wall can rest upon insertion of a skirted magazine into the grip well of a pistol. The lower grip wall can be wider than the space 76. Thus, the inclined surfaces 74 can also form part of the abutment surfaces for the grip walls, as shown by FIG. 2.

In another embodiment of the skirt 12 shown in FIG. 2, the horizontal length of the skirt 12 can be extended so as to extend the full length of the bottom of the grip wall—as illustrated by the dotted line A in FIG. 2.

In use, after the u-shaped member or skirt 12 is attached to the magazine 14, the magazine 14 is then inserted into the stock 49 of the firearm. It is the particular configuration (being inclined between about 20° and about 80° from the horizontal, and preferably between about 30° and about 50° from the horizontal) of the inclined surfaces 74 that especially assists prevention of an overinsertion of the skirted magazine into the grip well. Thus, the spaces 76 and the inclined surfaces 74 can act together to abut against the bottom end of the stock or grip 49 thereby preventing the firearm's interworking parts (and in particular the firearm parts and firearm mechanisms where the top of the magazine meets the top of the grip well) from being damaged by over-insertion of the magazine 14.

Additionally, the u-shaped member 12 can have a cross section, taken in a transverse direction, which is shaped to correspond to the cross-sectional shape of the stock of the firearm.

The magazine 14 defines the slot 62 having a shape and position in the front wall 20 of the case 30, such that when a user attempts to insert one more cartridge than is intended to be housed within the magazine chamber 28, the follower 36 is forced through the slot 62 thereby disabling the spring means 40 for urging the follower 36 in a direction towards the discharging end 32 of the case 30. The placement of the slot 62 thereby renders the magazine nonfunctional when the user inserts more cartridges into or alters the magazine chamber 28 to hold more cartridges than the magazine chamber 28 is intended for and additionally conforms with recently enacted Federal law regarding maximum cartridge capacity in firearms. For example, where the magazine 12 is constructed to hold a maximum of ten rounds of 0.45 caliber cartridges, a user may be able to insert eleven rounds of 9 mm caliber cartridges into the same cartridge by compressing the follower beyond the ten round position for 0.45 caliber cartridges. As explained above, such an activity can cause the follower to jam in slot 62.

Referring now to FIG. 7, the u-shaped member 12 defines an upper edge 64 having inclined surfaces 66 so that a bottom edge of the stock 49 and the upper edge 64 of the u-shaped member 12 intimately correspond and abut against one another.

Additionally, although not shown, it may be envisioned that the u-shaped member having outer first and second side walls 68 and 70 respectively, of the skirt 12, defines either a plurality of grooved surfaces or a roughened surface for enhancing manual gripping of the firearm by a user during shooting.

Another embodiment of the present invention is shown by FIGS. 12 to 14. A thin shim 78 can be interposed between hooks 50 and 52. The shim 78 serves to more firmly wedge the skirt 12 against the magazine 14. A version of the shim 78 can have a button 80 located so as to mate with a hole 82 in the magazine 14.

To summarize the manner in which the skirted magazine assembly 10 is firmly held in position in the grip well of a pistol: (1) the hooks (or angular prongs) 50 and 52 can act to prevent a rearward movement of the skirted magazine: (2) the curved surface 18 can act to prevent a forward movement of the skirted magazine; (3) the interaction of the tip 48 and the groove 44 can act to prevent a downward movement of the skirted magazine; and (4) the interaction of (a) the platform 58 in the slot 62, and/or the interaction of the button 80 in the hole 82 can act to prevent either an upwards or a downwards movement of the skirted magazine. The directions of movement set forth in this paragraph are in relation to the body of a user of a skirted magazine pistol, which user is holding the skirted magazine pistol in the normal (straight out) firing position and in front of upright or standing position of the user.

The high impact resistant polymer base skirt 12 surrounds that portion of the extended length magazine which extends outside the grip well and provides a smooth transition from the magazine to the pistol frame, thereby improving gun handling and reducing the possibility of catching the extended length magazine on clothing or other objects.

After use of the firearm, the skirt/magazine assembly 10, may be removed from the firearm in a conventional manner. The skirt/magazine assembly 10 thus removed may be reloaded, or another previously loaded skirt/magazine assembly 10 may be rapidly reinserted into the same style of firearm for continuous fire without the user having to be concerned about damaging the interworking parts of the firearm.

There has been described and illustrated herein, an improved skirt/magazine assembly for an autoloading firearm which allows for safe insertion of an extended magazine having additional round capacity while simultaneously preventing the insertion of an extra round in accordance with the maximum round capacity allowed by Federal law.

Further, the user is relieved of the necessity of maintaining a number of different styles of firearms. Additionally, due to the aforedescribed assembly, the magazine cartridges are insertable into the firearm in a smooth nonbinding manner, while excessive insertion is prevented.

More broadly and generally stated, a firearm of the sort loaded by inserting an ammunition-bearing magazine into the stock of a firearm may be provided with a longer magazine by using an extended, but compatible, magazine 14 and the skirt 12 of the present invention. The extended magazine 14, of course, may be capable of holding one or more additional rounds. More importantly, the lengthened stock by insertion of the skirt/magazine assembly 10 of the present invention is more reliably gripped by the user, and enables the user to handle the firearm more comfortably and to shoot it more accurately.

While particular embodiments of the invention have been described, it is not intended that the invention be limited exactly thereto, as it is intended that the invention be as broad in scope as the art will permit. The foregoing description and drawings will suggest other embodiments and variations within the scope of the claims to those skilled in the art, all of which are intended to be included in the spirit of the invention as herein set forth.

We claim:

1. A skirt for safely inserting an ammunition-bearing magazine into a stock of a firearm when the stock is shorter in length than said magazine, said skirt comprising:

(a) a generally u-shaped member defining an opening and having alignment means for engaging and aligning said u-shaped member with a bottom portion of said magazine;

(b) said opening of said u-shaped member defining retaining means for engaging said magazine in releasable interlocking assembly; and (c) said u-shaped member defining positioning means for establishing further alignment and attachment to said magazine, wherein when said magazine is fully inserted into the stock of the firearm said skirt prevents the firearm's interworking parts from being damaged, wherein said u-shaped member having a curved end and an open end and said retaining means of said u-shaped member defines a plurality of inward flanges located along inside edges of said open end for registry with an exterior rear wall of said magazine, wherein said u-shaped member made from a resilient material thereby allowing said flanges to engage said exterior rear wall of said magazine in releasable interlocking assembly.

2. A skirt according to claim 1, wherein said opening of said u-shaped member is shaped to correspond to the cross-sectional shape of said magazine, so that said u-shaped member may fit snugly around said magazine.

3. A skirt according to claim 1, wherein said alignment means of said u-shaped member defines a groove located along a convex bottom edge of said curved end for registry with an extended tab portion located at a bottom end of said magazine, wherein said groove and said extended tab portion align said skirt with said magazine for insertion into the stock of the firearm.

4. A skirt according to claim 1, wherein said curved end having a bottom and top surface, said top surface defining a generally curved upraised portion, wherein when said u-shaped member is attached to said magazine and said magazine is inserted into the stock of the handgun, said upraised portion abuts against a bottom end of the stock thereby preventing the firearm's interworking parts from being damaged by over-inserting said magazine.

5. A skirt for safely inserting an ammunition-bearing magazine into a stock of a firearm when the stock is shorter in length than said magazine, said skirt comprising:

(a) a generally u-shaped member defining an opening and having alignment means for engaging and aligning said u-shaped member with a bottom portion of said magazine;

(b) said opening of said u-shaped member defining retaining means for engaging said magazine in releasable interlocking assembly; and (c) said u-shaped member defining positioning means for establishing further alignment and attachment to said magazine, wherein when said magazine is fully inserted into the stock of the firearm said skirt prevents the firearm's interworking parts from being damaged, wherein said u-shaped member having a curved end and an open end and said positioning means of said u-shaped member defines an upraised curved portion located along a concave surface of said curved end for registry with a front wall of said magazine, wherein said front wall defines a slot for receiving said upraised curved portion thereby maintaining said skirt and magazine in assembled relationship.

6. A skirt according to claim 5, wherein said u-shaped member has a cross section, taken in a transverse direction, which is shaped to correspond to the cross-sectional shape of the stock of the handgun.

7. A skirt according to claim 5, wherein said u-shaped member has an upper edge, said upper edge having inclined surfaces so that the stock's bottom edge and said upper edge of said u-shaped member intimately correspond to one another.

8. A skirt/magazine assembly for housing cartridges and for safe insertion within a stock of a firearm when the stock is shorter in length than said magazine, said skirt/magazine assembly comprising:

(a) a skirt having an open end and a curved end;

(b) a magazine for storing cartridges having a cartridge discharging end and a closed end, said magazine having front, rear, first and second side walls, interior surfaces of said walls defining a magazine chamber;

(c) alignment means for engaging and aligning said curved end of said skirt with said closed end of said magazine;

(d) retaining means for engaging said skirt with said magazine in releasable interlocking assembly; and (e) positioning means for establishing further alignment and attachment of said skirt with said magazine, wherein when said magazine is fully inserted into the stock of the firearm, said skirt prevents the firearm's interworking parts from being damaged by over-insertion of said magazine, wherein said retaining means of said skirt defining a plurality of inward flanges located along inside edges of said open end for registry with said rear wall of said magazine, wherein said skirt made from a resilient material thereby allowing said flanges of said skirt to engage said rear wall of said magazine in releasable interlocking assembly.

9. A skirt/magazine assembly according to claim 8, wherein said open end of said skirt is shaped to correspond to the exterior cross-sectional shape of said walls of said magazine, so that said skirt may fit snugly around said magazine.

10. A skirt/magazine assembly according to claim 8, wherein said alignment means comprises of said skirt defining a groove located along a convex bottom edge of said curved end for registry with an extended tab portion located and positioned at said closed end of said magazine, wherein said groove and said extended tab portion align said skirt with said magazine for insertion into the stock of the firearm.

11. A skirt/magazine assembly according to claim 8, wherein said curved end having a bottom and top surface, said top surface defining a generally curved upraised portion, wherein when said skirt/magazine assembly is inserted into the stock of the handgun, said upraised portion abuts against a bottom end of the stock thereby preventing the firearm's interworking parts from being damaged by over-inserting said skirt/magazine assembly.

12. A skirt/magazine assembly for housing cartridges and for safe insertion within a stock of a firearm when the stock is shorter in length than said magazine, said skirt/magazine assembly comprising:

(a) a skirt having an open end and a curved end;

(b) a magazine for storing cartridges having a cartridge discharging end and a closed end, said magazine having front, rear, first and second side walls, interior surfaces of said walls defining a magazine chamber;

(c) alignment means for engaging and aligning said curved end of said skirt with said closed end of said magazine;

(d) retaining means for engaging said skirt with said magazine in releasable interlocking assembly; and (e) positioning means for establishing further alignment and attachment of said skirt with said magazine, wherein when said magazine is fully inserted into the stock of the firearm, said skirt prevents the firearm's interworking parts from being damaged by over-insertion of said magazine, wherein said positioning means comprises of said skirt defining an upraised curved portion located along a concave surface of said closed end for registry with said front wall of said magazine, wherein said front wall defines a slot for receiving said upraised curved portion thereby maintaining said skirt and magazine in assembled relationship.

13. A skirt/magazine assembly according to claim 12, wherein said skirt having a cross section, taken in a transverse direction, which is shaped to correspond to the cross-sectional shape of the stock of the handgun.

14. A skirt/magazine assembly according to claim 12, wherein said skirt having an upper edge, said upper edge having inclined surfaces so that the stock's bottom edge and said upper edge of said skirt intimately correspond to one another.

15. A skirt/magazine assembly according to claim 12, wherein said magazine cartridge of said magazine having an approximate length to hold ten cartridges.

16. A skirt/magazine assembly according to claim 12, wherein said magazine having a follower mounted for sliding movement within said magazine chamber and adapted to contact one of the cartridges and means for urging said follower in a direction towards said discharging end of said case, said magazine having positioning means, wherein said positioning means being of such shape and position to prevent a user from inserting more cartridges in said magazine chamber then said magazine chamber is designed to house.

17. A skirt/magazine assembly according to claim 16, wherein said means for urging said follower in a direction towards said discharging end of said magazine comprises a spring affixed to an underside of said follower at one end and affixed to said closed end of said magazine at the other end.

18. A skirt/magazine assembly according to claim 16, wherein said positioning means defines a slot located in said front wall of said magazine, wherein when a user attempts to insert one more cartridge then intended to be housed within said magazine chamber, said follower is forced through said slot thereby disabling said means for urging said follower in a direction towards said discharging end of said magazine.

* * * * *